United States Patent [19]

Shishido

[11] Patent Number: 5,020,830

[45] Date of Patent: Jun. 4, 1991

[54] SEALED CARD

[75] Inventor: Shigenari Shishido, Tokyo, Japan

[73] Assignee: Sayama Kako Co., Ltd., Tokyo, Japan

[21] Appl. No.: 470,761

[22] Filed: Jan. 26, 1990

[30] Foreign Application Priority Data

Jan. 28, 1989 [JP] Japan ..... 1-8437

[51] Int. Cl.[5] ..... B42D 15/02

[52] U.S. Cl. ..... 283/101; 283/111; 229/92.8; 428/202

[58] Field of Search ..... 282/8 R, DIG. 2, 1 A, 282/12 R, 28 R; 283/101, 100, 99, 98, 94, 110, 111; 428/202, 203, 204; 229/92.8

[56] References Cited

U.S. PATENT DOCUMENTS

| | | | |
|---|---|---|---|
| 3,891,242 | 6/1975 | Arnold et al. | 283/101 |
| 4,174,857 | 11/1979 | Koza | 283/101 |
| 4,278,199 | 7/1981 | Tanaka | 229/92.8 |
| 4,378,392 | 3/1983 | Segel | 428/204 |
| 4,421,816 | 12/1983 | Arnold | 428/204 |
| 4,598,003 | 7/1986 | Renholts | 428/204 |
| 4,624,875 | 11/1986 | Watanabe et al. | 428/202 |
| 4,742,954 | 5/1988 | Shishido | 283/111 |
| 4,807,807 | 2/1989 | Glick | 229/92.8 |
| 4,885,198 | 12/1989 | Kimura | 283/101 |

*Primary Examiner*—Frank T. Yost
*Assistant Examiner*—Hwei-Siu Payer
*Attorney, Agent, or Firm*—Michael L. Keller

[57] ABSTRACT

A sealed card comprises a card substrate and a cover sheet disposed over the surface of the card substrate for sealing the substrate, wherein a transparent resin film having a thin transferable membrane with a hiding power releasably deposited thereon is put between the card substrate and the cover sheet by a transparent pressure sensitive adhesive layer and another pressure sensitive adhesive layer, respectively. The card surface is usually covered and concealed by the cover sheet and the thin transferable membrane and can be read through the transparent resin film by easily peeling the cover sheet together with the thin transferable member from the surface of the resin film. The sealed card can be manufactured easily.

4 Claims, 2 Drawing Sheets

SEALED CARD

BACKGROUND OF THE INVENTION

1. Field of the Invention

The present invention concerns a sealed card in which a specific area of a card surface is concealed by a releasable cover sheet having hiding power.

2. Description of the Prior Art

A sealed card with a printed or handwritten message on its surface and having a cover sheet releasably attached thereover has been proposed by, for example, the inventor of the present patent application in U.S. Pat. No. 4,742,954, and has already been put to practical use. However, as sealed cards of this type have become popular in various applications, demands for improvements and cost savings have been made concerning the constituent materials and their production steps.

SUMMARY OF THE INVENTION

The object of the present invention is to provide a sealed card capable of satisfying the above requirements.

The foregoing object of the present invention can be attained by a sealed card comprising a card substrate having a surface to be concealed and a cover sheet disposed over the surface of the card substrate for sealing the same, wherein a transparent resin film on which a thin transferable membrane having a hiding power is releasably deposited is put between the card substrate and the cover sheet by a transparent pressure sensitive adhesive layer and another pressure sensitive adhesive layer respectively.

The transferable membrane having a hiding power will be described in more detail below. However, hiding power simply means the ability to conceal the material appearing on the surface of the card substrate and can be accomplished by any suitable opaque material. The opaque membrane is deposited on the transparent resin film in such a manner that it is releasable or peelable from the transparent resin film when pressure is exerted.

In the present invention, the transparent resin film with the thin transferable membrane having hiding power being releasably deposited thereon is sandwiched between the upper surface of the card substrate and the lower surface of the cover sheet by means of a transparent pressure-sensitive adhesive layer and another pressure-sensitive adhesive layer respectively, in such a way that the upper surface of the card substrate is always covered by the cover sheet and concealed by the thin transferable membrane having hiding power.

In the present invention, since the cover sheet, the resin film, and the card substrate are firmly adhered together by the respective pressure sensitive adhesive-layers, they are always integrated together and are not separated by usual handling.

When the cover sheet is peeled off the card substrate, since the bonding strength of each pressure-sensitive adhesive layer is greater than the peeling strength between the thin transferable membrane and the surface of the resin film, the deposited thin transferable membrane is easily peeled off the resin film and transferred to the lower surface of the cover sheet. In other words, the transferable membrane is removed together with the cover sheet from the card substrate. Then, the resin film removed with the thin transferable membrane becomes transparent, and remains as it is on the surface of the card substrate with the transparent pressure-sensitive adhesive layer therebetween. Thus, a printed or handwritten message on the surface of the card substrate can now be read through the transparent resin film.

The resin film releasably carrying the thin transferable membrane having hiding power can be prepared easily or commercially available as, for example, one of the thermal transfer printing ribbons or tapes widely used at present for thermal transfer printers, etc.

Commercial thermal transfer printing ribbons are usually formed by dispersing fine particles of, for example, carbon or metal or metal oxide into an organic solvent together with an appropriate binder, coating the resultant dispersion onto the surface of a resin film such as one made of polyester and, further, coating a heat-sensitive adhesive layer onto the upper surface thereof. The thin transferable membrane can also be prepared by vacuum vapor deposition of the above-mentioned fine metal or metal oxide particles onto the surface of the resin film.

The heat-sensitive adhesive resin layer which is coated onto the surface of the thin transferable membrane is used for thermal transfer printing, but this is not always necessary in the present invention. However, as described below, the heat-sensitive adhesive resin layer is preferably used for facilitating the production of the sealed card.

The thin transferable membrane having the hiding power is usually formed over the entire surface of the resin film. In a preferred embodiment of the present invention, however, the thin transferable membrane formed on the resin film may be patterned such that its outer circumferential periphery is removed to expose the underlying film surface in, for example, a frame-like shape.

It is essential that there is sufficient difference between the peeling strength of the thin transferable membrane from the resin film surface and the bonding strength of each pressure-sensitive adhesive to the corresponding resin film or to the card substrate. From a practical point of view, in manufacturing the sealed card of the present invention, most of the usual pressure-sensitive adhesives used for adhesive tapes or labels have bonding strength much greater than the peeling strength of the thin transferable membrane, even when the latter strength varies somewhat depending on the composition of the transferable membrane, coating or depositing conditions thereof, etc.

DESCRIPTION OF THE ACCOMPANYING DRAWINGS

These and other objects, as well as advantageous features of the present invention will be described by way of its preferred embodiments referring to the accompanying drawings, wherein FIG. 1 is a longitudinal cross sectional view showing a laminate as a basic component used for a preferred embodiment of the present invention;

DESCRIPTION OF THE PREFERRED EMBODIMENT

Figure 1:
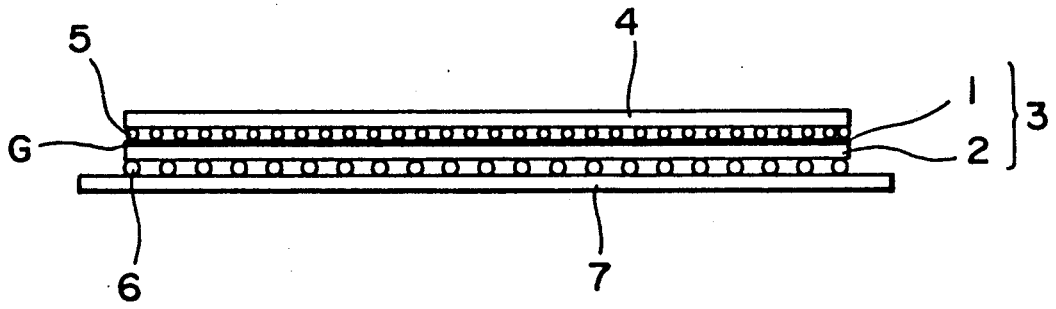

The present invention will now be described specifically with reference to examples shown in the drawings.

EXAMPLE 1

FIG. 1 is a longitudinal cross sectional view showing a laminate as a basic component used for a preferred embodiment of the present invention.

In the example shown in FIG. 1, a thin transferable black membrane 1 comprising fine carbon particles is coated as a solution of an organic solvent onto the surface of a transparent polyester film 2 of about 14 μm in thickness, followed by drying, and a heat-sensitive adhesive resin layer (not illustrated) is applied onto the surface of the membrane. A thin carbon membrane-coated composite resin film 3 (hereinafter referred to as a composite film) formed in this way is actually available from various manufacturers as a thermal printing ribbon or tape used for thermal transfer printers. A cover sheet 4 made of high-quality paper is bonded by a pressure-sensitive adhesive layer 5 over the entire upper surface of the thin transferable membrane 1. The composite film 3 is attached temporarily to a silicon-treated releasable paper 7 by a transparent pressure-sensitive adhesive layer 6.

Figure 2:
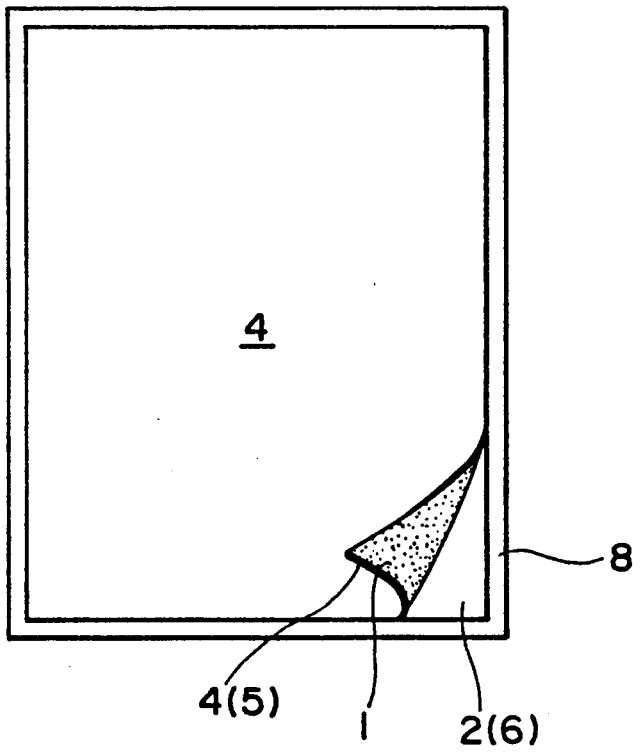
FIG. 2 is an explanatory plan view of one embodiment of a post card according to the present invention.

Upon using the thus prepared laminate, the releasable paper 7 is removed and the upper surface of a card 8 is bonded to the adhesive layer 6 as shown in FIG. 2.

A printed or handwritten message on the upper surface of the card 8 is usually sealed by the cover sheet 4 and concealed, particularly, by the aluminum thin transferable membrane 1 in the laminate.

When the cover sheet 4 is removed from the card 8, peeling occurs at a releasable boundary G (FIG. 1) between the thin transferable membrane 1 and the transparent resin film 2, since the peeling strength between them is much lower than that of the adhesive layer 5 or 6.

As a result, the cover sheet 4 is removed from the card 8 together with the thin transferable membrane 1 now transferred to the lower surface of the sheet 4. Thus, the transparent resin film 2 removed with the transferable membrane 1 remains on the upper surface of the card 8, and the message on the upper surface of the card 8 can be seen through the transparent resin film 2 and the transparent adhesive layer 6.

Since the constituent layers 3, 4, 8 of the laminated card are bonded by means of the adhesive layers 5 and 6, they are usually integrated together firmly.

However, it is more preferred to apply appropriate means so that the card laminate may not be accidentally peeled along the easily releasable boundary G between the thin transferable membrane 1 and the resin film 2 by an external force exerted to the end face of the lamination. The following example provides such a securing means.

EXAMPLE 2

Figure 3:
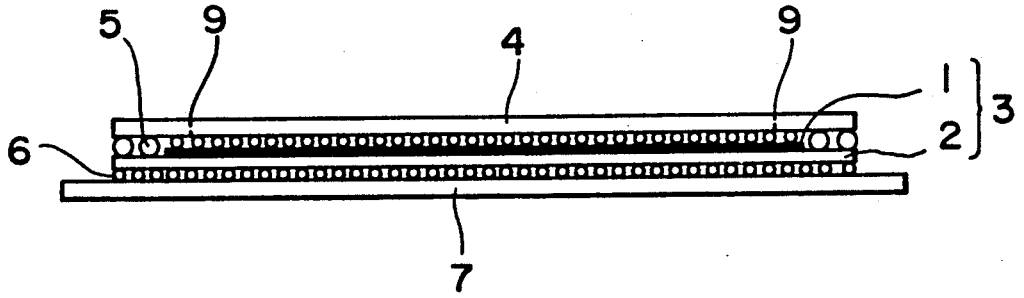
FIG. 3 is a longitudinal cross sectional view showing a laminate as a basic component used for another embodiment of the present invention.
Figure 4:
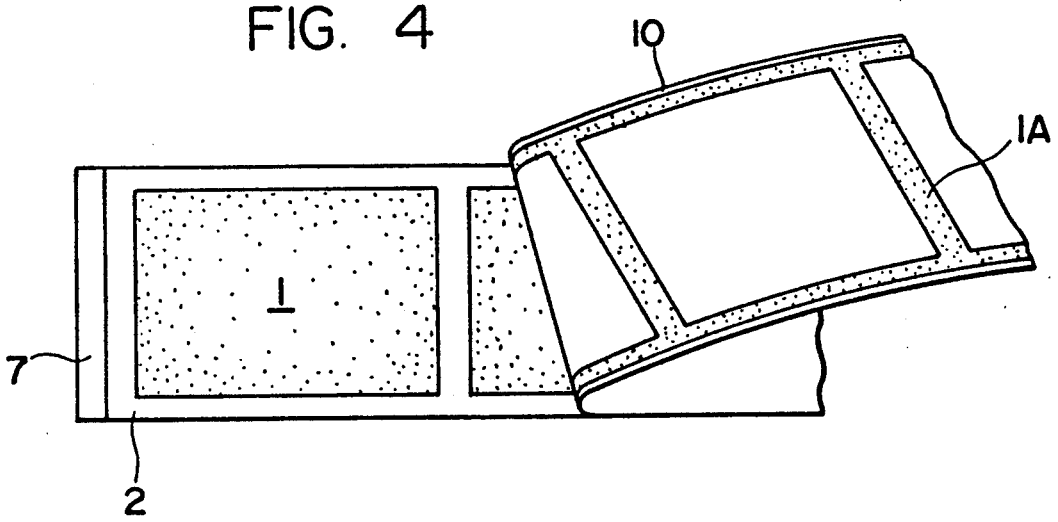
FIG. 4 is an explanatory view showing a production step thereof.
Figure 5:
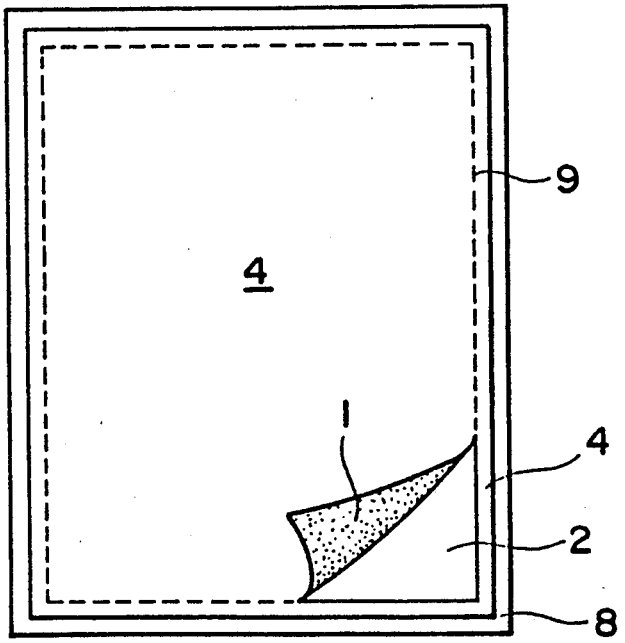
FIG. 5 is an explanatory plan view of another embodiment of a post card according to the present invention.

FIG. 3 is a longitudinal cross sectional view showing a laminate as a basic component used for another embodiment of the present invention, FIG. 4 is an explanatory view showing a production step thereof, FIG. 5 is an explanatory view of a post card attached with a cover sheet shown in FIG. 3, in a state of peeling the cover sheet.

The structure of the laminate shown in FIG. 3 is substantially the same as that of Example 1 shown in FIG. 1. (corresponding parts carry the same reference numerals), excepting that a thin transferable membrane 1 deposited on a transparent resin film 2 is patterned such that the outer periphery thereof is removed as shown in FIGS. 3, 4 so as to expose the underlying resin film 2 in a frame-like shape. In the thus patterned form, the thin transferable membrane 1 has a sufficient size to conceal at least a main area on the upper surface of a card 8 on which a message, etc. are present (FIG. 5).

In order to pattern the thin transferable membrane 1 on the resin film 2 as described above, a composite film 3 comprising the thin transferable membrane 1 deposited on the upper surface of the resin film 2 is temporarily bonded to the surface of a releasable paper 7 by way of a transparent pressure-sensitive adhesive layer 6 and then a paper sheet 10 is laid over the heat sensitive adhesive layer (not illustrated) formed on the upper surface of the transferable membrane 1. Then, a hot pressing is applied in a pattern corresponding to a frame portion 1A (FIG. 4) from the upper side of the paper sheet 10.

Then, the heat sensitive adhesive resin layer on the surface of the thin transferable membrane 1 is fused and adhered to the inner surface of the paper sheet 10 as shown by a frame-like portion 1A in FIG. 4 when the sheet 10 is removed. As a result, the thin transferable membrane 1 remains on the resin film 2 in a patterned shape corresponding to the printed area on the upper surface of a card 8 (also refer to FIG. 5).

A cover sheet 4 is bonded to the surface of the composite film 3 on the side of the thin transferable membrane 1 by a pressure sensitive adhesive 5 as shown in FIG. 3. A perforation line 9 is formed through the cover sheet 4 in adjacent with the inside of the thus patterned thin transferable membrane 1.

After peeling off the releasable paper 7, the laminate 4, 3, is bonded to a card 8 made of paper by a transparent pressure sensitive adhesive layer 6.

The card 8 in this case is a usual post card and an area for handwriting or printing a message is formed at the surface thereof, while the area for address, etc. is formed at the rearface thereof (not illustrated).

In this embodiment, the message on the surface of the card 8 is usually sealed by the cover sheet 4 and concealed from the outside by the thin transferable membrane 1 having hiding power on the resin film 2, and the composite film 3 and the cover sheet 4 are completely integrated to the lower card 8 by the pressure sensitive adhesive layers 5 and 6.

When a recipient intends to peel off the cover sheet 4 from the card 8, he can peel the cover sheet 4 manually or by using a cutting knife, etc. as shown in FIG. 5 and remove it from the lower resin film 2 along the releasable boundary G (shown in FIG. 1).

In this case, peeling always occurs along the easily releasable boundary G between the thin transferable membrane 1 and the resin film 2, by which the thin transferable membrane 1 is peeled off the upper surface of the resin film 2 and transferred to the lower surface of the cover sheet 4, while being caught by the pressure sensitive adhesive 5. In this case, after peeling off the cover sheet 4, the transparent resin film 2 remains on the card 8 while being bonded by the pressure-sensitive adhesive 6, and the message on the card 8 can be seen through the transparent film 2.

In this embodiment, since the cover sheet 4, the resin film 2, etc. are bonded and integrated to the card 8 by the pressure sensitive adhesive layers 5 and 6, respectively, to form a sealed post card, they can not be peeled off or displaced by usual handling.

In particular, since the cover sheet 4 is adhesive-bonded firmly to the frame-like portion of the resin film 2 at the outer periphery of the patterned thin transferable membrane 1 as well as over the thin transferable membrane 1, there is no worry that the easily releasable boundary G at the laminated end face is exposed externally, to accidentally trigger peeling of the thin transferable membrane 1 from the resin film 2.

In a further modified embodiment of the present invention, the cover sheet may be made of a thermoplastic resin film since the necessary hiding power can be provided by the thin transferable membrane.

In this embodiment, the heat-sensitive adhesive resin layer is formed over the thin transferable membrane to a thickness greater than usual case, for example, of about 50–60 μm.

Then, a cover sheet made of a thermoplastic resin film is laid over the entire surface of the transferable membrane and hot-pressing is applied from the upper surface of the cover sheet such that at least a peripheral portion of the heat-sensitive adhesive resin layer is fused to cover the end face of the lamination of the thin transferable membrane and the resin film.

Accordingly, the easily releasable boundary between them is not exposed externally to prevent accidental peeling.

An appropriate perforation line is applied like that in the previous embodiment shown in FIGS. 3, 5.

This modified embodiment can be manufactured especially easily.

Instead of the thermoplastic resin film, a paper sheet laminated or coated with a heat sensitive adhesive resin layer may be used.

Although the present invention has been described with reference to typical examples, the present invention is not restricted only to these examples but can be modified or changed variously.

For example, the thin transferable membrane formed on the resin film can also be formed by vapor deposition of fine metal or metal oxide particles such as aluminum particles instead of coating the dispersion of the carbon particles so long as they have satisfactory transferring property and hiding power.

The present invention can also be used for a so-called composite label having a card-like substrate as a main label substrate and having a cover sheet as a sub-label substrate.

What is claimed is:

1. A sealed card comprising (a) a card substrate having a surface to be concealed;

(b) a cover sheet disposed over the surface of said card substrate for sealing said surface;

(c) a transparent resin film having a thin opaque membrane peelably deposited on said film, said film and membrane being positioned between said substrate and said cover sheet;

(d) a transparent pressure sensitive adhesive layer disposed between said card substrate and said resin film; and (e) a second pressure sensitive adhesive layer disposed between said opaque membrane and said cover sheet, wherein the bonding strength of said second pressure-sensitive adhesive layer is greater than the peeling strength of said opaque membrane.

2. A sealed card as defined in claim 1, wherein said thin opaque membrane is prepared by coating a solution of fine carbon articles in an organic solvent over the surface of the transparent resin film.

3. A sealed card as defined in claim 1, wherein said thin opaque membrane is prepared by vapor deposition of fine metal or metal oxide particles over the surface of the transparent resin film.

4. A sealed card as defined in claim 1, wherein said thin opaque membrane is patterned in such a way that the underlying transparent resin film is exposed at the periphery of said membrane.

* * * * *